United States Patent [19]

Schibbye

[11] 4,004,864

[45] Jan. 25, 1977

[54] METHOD FOR MODIFYING A COMPRESSING APPARATUS UNIT

[75] Inventor: Lauritz Benedictus Schibbye, Saltsjo-Duvnas, Sweden

[73] Assignee: Svenska Rotor Maskiner Aktiebolag, Nacka, Sweden

[22] Filed: June 23, 1975

[21] Appl. No.: 589,210

[30] Foreign Application Priority Data

July 1, 1974 United Kingdom ..... 29038/74

[52] U.S. Cl. ..... 418/1; 418/201

[51] Int. Cl.[2] ..... F04C 15/02

[58] Field of Search ..... 418/201, 203, 202, 197, 418/1

[56] References Cited

UNITED STATES PATENTS

| | | | |
|---|---|---|---|
| 3,314,597 | 4/1967 | Schibbye | 418/203 |
| 3,424,373 | 1/1969 | Gardner | 418/201 |
| 3,432,089 | 3/1969 | Schibbye | 418/201 |
| 3,738,780 | 6/1973 | Edstrom | 418/201 |
| 3,869,227 | 3/1975 | Kocher et al. | 418/201 |
| 3,877,846 | 4/1975 | Lundberg | 418/201 |

FOREIGN PATENTS OR APPLICATIONS

| | | | |
|---|---|---|---|
| 1,118,800 | 12/1961 | Germany | 418/201 |

*Primary Examiner*—C. J. Husar
*Attorney, Agent, or Firm*—Flynn & Frishauf

[57] ABSTRACT

Method for modifying a compressing apparatus comprising a prime mover and a screw compressor for a higher compression ratio and constant power by extending the inlet port so that the cut off from the inlet channel takes place at a later angular position of the rotors than the normal design position.

13 Claims, 3 Drawing Figures

METHOD FOR MODIFYING A COMPRESSING APPARATUS UNIT

The present invention relates to a method for modifying a compressing apparatus to a higher compression ratio than the normal design one with substantially the same power consumption. The method is applicable in particular to apparatus comprising a prime mover and a screw compressor directly connected thereto in which the compressor is designed and dimensioned to accurately fit or match the maximum available power of the prime mover at a certain design compression ratio.

Prime movers, either internal combustion engines or electrical motors, suitable to drive compressors of the screw rotor type are normally available in certain sizes with regard to the power allowable for continuous drive and at a certain speed. In order to produce a compressing apparatus unit having optimum economical characteristics it is widely accepted to dimension and design the screw compressor so that it accurately watches the characteristics of the prime mover chosen. Such a screw compressor is designed for the most commonly used drive conditions, i.e. compression of air from atmospheric pressure up to a discharge pressure of about 100 psig (i.e. 7 kg/cm² gage or 700 kPa gage pressure). The compression ratio is thus about 8 to 1.

Compressing apparatus of such types are mass produced and are available at relatively low prices. However, sometimes, a somewhat higher discharge pressure than the "design" discharge pressure is required. Up to now it has not been possible to use units of the above discussed type in such instances as the power necessary for driving the compressor of the unit up to the higher discharge pressure will be too high for the prime mover and consequently there has been no other way left than to use a specially designed compressor available only at a much higher price or to provide the unit with further space and cost consuming means.

SUMMARY OF THE INVENTION

The object of the present invention is to achieve a method for a simple and inexpensive modification of the compression unit so that the discharge pressure can be increased without increasing the power required over and above the power available from the prime mover. Normally for an air compressor this means that the discharge pressure should be increased from 100 psig to about 115 psig (8 kg/cm² gage or 800 kPa gage pressure).

An absolute condition for the increase of the pressure rise under unchanged power consumption is that the mass of the fluid, such as gas, passing through the compressor is reduced. Such a reduction of the fluid or gas flow could be obtained by a decrease of the speed of the compressor or by a throttling of the compressor inlet. As the prime mover must run at its normal speed in order to produce the required power, a reduction of the compressor speed can only be obtained by the insertion of a speed reducing transmisson between the prime mover and the compressor. By throttling of the compressor inlet by means of a separate throttling valve the internal pressure ratio of the compressor increases still more and also, large throttling losses are obtained. The losses obtained in this way are so large that the efficiency of the compressor will be poor and the volumetric capacity will be consequently too low for an economical use of the unit.

According to the invention the above described transmission or throttling means are avoided and the reduction of the volumetric capacity is instead obtained by returning a certain amount of practically uncompressed gas from the working space of the compressor to the inlet channel thereof.

BRIEF DESCRIPTION OF THE DRAWINGS

The invention will now be discussed in detail and by way of example with reference to the accompanying drawings in which.

DETAILED DESCRIPTION OF ILLUSTRATED EMBODIMENT

Figure 1:
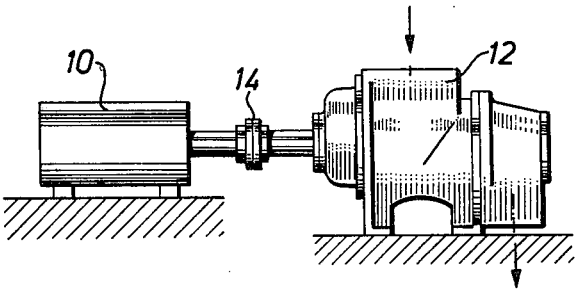
FIG. 1 shows a compression apparatus of the type to which the invention relates.

The compression apparatus shown in FIG. 1 comprises a prime mover 10, such as an electrical motor, and a screw compressor 12 directly connected to the motor 10 by means of a shaft coupling 14.

Figure 2:
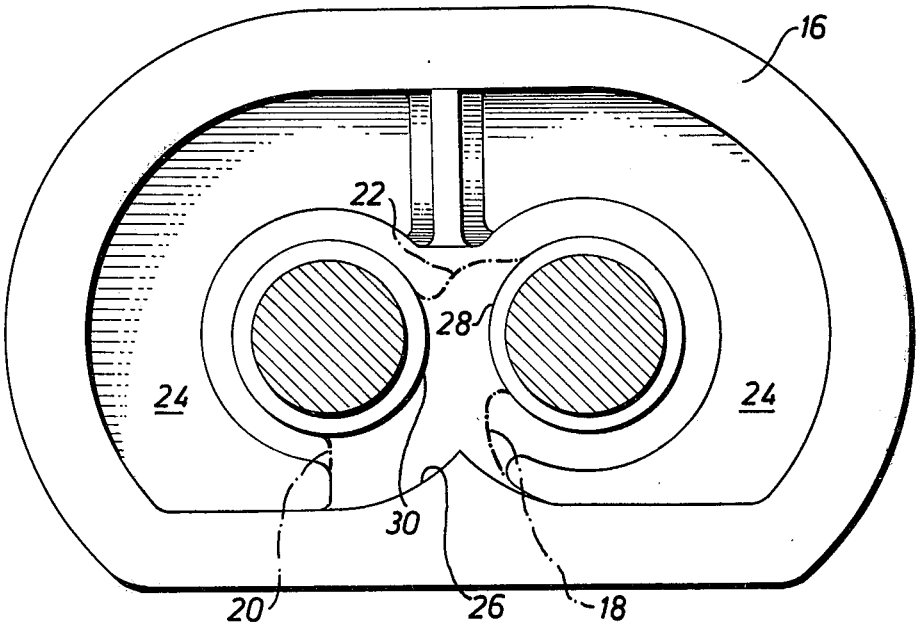
FIG. 2 is a transverse section of the compressor of apparatus showing the low pressure end plate member.

In the compressor low pressure end plate member 16 shown in FIG. 2, the normal edges 18, 20, 22 of the low pressure port 24 are indicated by dotted lines. The shape of the actual portion of the inlet port 24 according to the invention is indicated by the lines 26, 28, 30.

Figure 3:
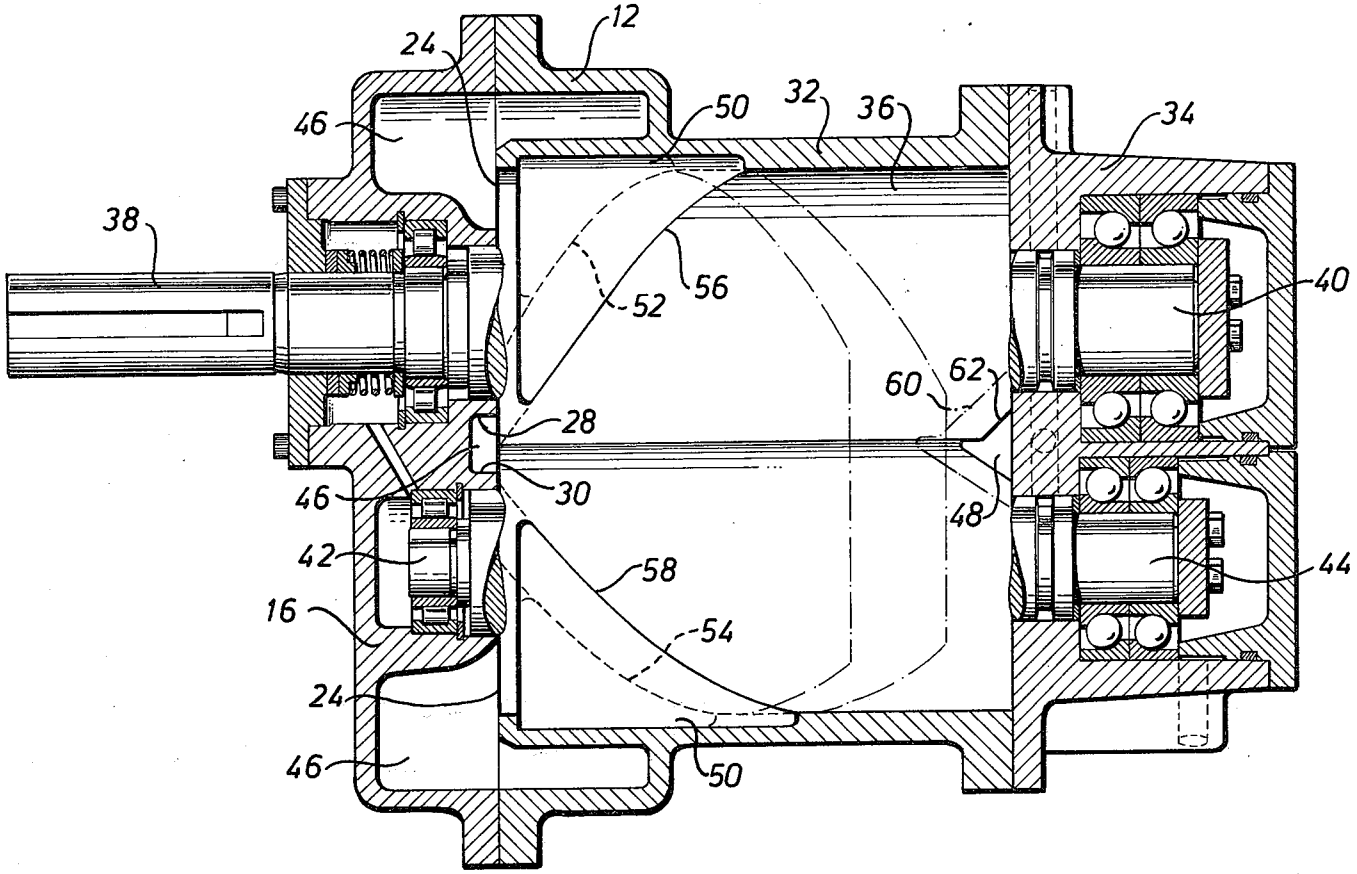
FIG. 3 is a horizontal section through the compressor with the rotors cut away.

In FIG. 3 it is clearly shown that the casing of the compressor 12 comprises a low pressure end plate member 16, a barrel member 32 and a high pressure end plate member 34. The casing encloses a working space 36 in which the rotors of which only the shafts 38, 40, 42, 44 are shown. The rotor shafts are mounted on the end plate members 16, 34 by means of antifriction bearings. The shaft 38 of the male rotor further extends outside the casing for connection to the prime mover 10 by means of the coupling 14 (FIG. 1).

The working space 36 communicates with an inlet channel 46 through the low pressure port 24 and with an outlet channel through a high pressure port 48.

The barrel surface of the working space 36 is provided with a relieved portion 50 which is in flow communication with the inlet channel 46 and out of sealing adjacency to the rotor tips. This relieved portion is restricted peripherally by edges following screw lines having the same lead angle as tips of the cooperating rotor. The normal positions of those edges in a conventional design are indicated by the dotted lines 52, 54, whereas the position according to the invention is indicated by the lines 56, 58.

With regard to the high pressure port 48 its normal shape in a conventional design is indicated by the dotted line 60, whereas its shape according to the invention is indicated by line 62.

The modification according to the invention thus means that the low pressure phase of the compressor is extended into the normal compression phase. In this way the volume and consequently the mass of gaseous working fluid trapped within the compressor and cut off from the inlet channel is reduced without any appreciable losses.

This result is of the utmost importance in a compression apparatus unit of the type specified above when there is a requirement for a higher discharge pressure than the normal one for which the unit is normally designed. If for instance the unit is designed for a discharge pressure of about 100 psig and the required discharge pressure is about 115 psig, the power heretofore necesssary for compressing the same amount of gas would be about 7% larger than for the normal design conditions. However, as the unit is designed in the most ecconomical way for its normal use, i.e. the prime mover is dimensioned such that the power output thereof is practically at the upper limit allowable according to the guarantees of the manufacturer, a continuous overloading of the prime mover is not acceptable. The aim of the invention is to solve this problem and the desired result is achieved by increasing the low pressure phase into the normal compression phase to such an extent that the actual border between said phases is located at a position where in normal use the volume of the gas to be compressed is decreased to about the same extent as the power consumption of the compressor has to be reduced in order to fit the guaranteed power of the prime mover.

This modification of the extent of the low pressure phase can be obtained in different ways. The simplest and cheapest way is to increase the size of the axial low pressure port by a cutting operation in an already available low pressure end plate member or by a very small adjustment of the casting model for this end plate member. The costs for such a modification will be practically negligible in relation to the total cost of the unit. However, the reduction of the volumetric capacity that can be obtained in this way will not be larger than 5 to 7% which corresponds to an increase of the discharge pressure of about 10 to 15%.

When the requirement for the increase of the discharge pressure is higher than about 10 to 15% it is necessary to modify the barrel portion of the casing by increasing the relieved portion thereof for adjustment of the position of the edge defining the border between the low pressure and the compression phases. This modification can also be produced relatively simply by a cutting operation or by an adjustment of the casting model. In this way practically any desired reduction of the volumetric capacity can be obtained.

The two ways discussed above for reduction of the volumetric capacity can be used separately or in combination.

In order to achieve the highest possible efficiency of the modified compressor the pressure of the gaseous fluid when brought into communication with the outlet channel should be as close to the pressure in said channel as possible. This means that the size of the high pressure port should be reduced so that the ratio between the trapped volume and the volume opened up towards the outlet channel should correspond to the ratio between the discharge and inlet pressures. If it is assumed that the compressor is normally designed for a pressure ratio of 8 to 1 by providing a volume ratio of 4.4 to 1 and that it should be modified for a pressure ratio of 9 to 1 corresponding to a volume ratio of about 4.8 to 1 by a reduction of the volumetric capacity of 7%, the outlet volume should be reduced from about (100/4.4) = 22.7% to about (93/4.8) = 19.4% of the maximum theoretical inlet volume of the compressor. This reduction of the high pressure port cannot be achieved by a cutting operation but is only achieved when the casting models are adjusted.

I claim:

1. Method for modifying a compressing apparatus unit to a higher compression ratio than the normal design compression ratio with substantially the same power consumption, said unit comprising a prime mover and a screw compressor directly connected thereto, said screw compressor including a barrel member and at least two intermeshing screw rotors sealingly mounted therein, said compressor being designed and dimensioned, and having predetermined design inlet port size, to accurately match the maximum available power of the prime mover at said normal design compression ratio, the normal design compression phase of said compressor beginning at a predetermined point therein, comprising extending the inlet port of said compressor to a greater size than said predetermined design size and into said normal design compression phase of said compressor to decrease the volumetric capacity of said compressor, the increase in power consumption owing to the higher compression ratio being balanced by a decrease thereof owing to the resulting decrease in volumetric capacity.

2. Method according to claim 1, wherein the inlet port is an axial inlet port and comprising extending said inlet port to completely encircle the shaft of at least one of said rotors.

3. Method according to claim 2, comprising extending the axial inlet port around the shaft of the female rotor.

4. Method according to claim 1, comprising relieving a portion of the barrel wall to avoid sealing action with the rotor tips, the relieved wall portion being in flow communication with the inlet channel of the compressor; and extending a radial inlet port by an angular increase of the relieved portion of the barrel walls to increase the area over which sealing action with the rotor tips is avoided.

5. Method according to claim 1, further comprising decreasing the size of the outlet port from its normal design size as a function of the decreased volumetric capacity and to the increased pressure ratio.

6. Method according to claim 1, wherein said compressor comprises a low pressure end plate member defining said inlet port, and wherein the step of extending the inlet port comprises cutting away at least a portion of said end plate member to enlarge the size of said inlet port.

7. Method according to claim 1, wherein said compressor comprises a low pressure end plate member defining said inlet port, the end plate member being cast by means of a casting model of predetermined dimension, wherein the step of extending the inlet port comprises adjusting the dimensions of said casting model so as to permit casting of an end plate member with an inlet port of greater size than the predetermined design size.

8. Method according to claim 4, wherein an edge of the relieved wall portion defines the border between the low pressure and the compression phases of the machine, the position of said edge being varied by angularly increasing the relieved portions of the barrel walls.

9. Method according to claim 8, comprising defining said edge of said relieved wall portion to follow screw lines having substantially the same lead angle as the tips of the cooperating rotors.

10. Method for modifying a compressing apparatus unit to a higher compression ratio than the normal design compression ratio with substantially the same power consumption, said unit comprising a prime mover and a screw compressor directly connected thereto, said screw compressor including a barrel member and at least two intermeshing screw rotors sealingly mounted therein, said compressor being designed and dimensioned, and having predetermined design inlet port size, to accurately match the maximum available power of the prime mover at said normal design compression ratio, the normal design compression phase of said compressor beginning at a predetermined point therein, a portion of the barrel wall being relieved and out of sealing adjacency with the rotor tips to avoid sealing action with the rotor tips, the relieved wall portion being in flow communication with the inlet channel of the compressor, an edge of the relieved portion defining the border between the low pressure and the compression phases of the machine, comprising increasing the size of said relieved wall portion to adjust the position of said edge of the relieved wall portion further into the compression phase of the machine to decrease the volumetric capacity of said compressor, the increase in power consumption owing to the higher compression ratio being balanced by a decrease thereof owing to the resulting decrease in volumetric capacity.

11. Method according to claim 10, wherein the step of increasing the size of said relieved wall portion comprises angularly increasing the relieved portions of the barrel walls.

12. Method according to claim 11, wherein said edge of said relieved wall portion follows screw lines having substantially the same lead angle as the tips of the cooperating rotors, the angular position of said edge being varied to increase the size of said relieved wall portion.

13. Method according to claim 10, further comprising decreasing the size of the outlet port from its normal design size as a function of the decreased volumetric capacity and to the increased pressure ratio.

* * * * *